United States Patent [19]

Kidd et al.

[11] 4,183,110

[45] Jan. 15, 1980

[54] CASUALTY TRANSFER SYSTEM

[75] Inventors: Derek J. Kidd; Leslie B. Goodwin, both of Victoria, Canada

[73] Assignee: Her Majesty the Queen in right of Canada, as represented by the Minister of National Defence, Ottawa, Canada

[21] Appl. No.: 883,900

[22] Filed: Mar. 6, 1978

[30] Foreign Application Priority Data

Apr. 7, 1977 [CA] Canada ..... 275897

[51] Int. Cl.[2] ..... A61G 1/02; A47B 96/00

[52] U.S. Cl. ..... 5/82 R; 9/5

[58] Field of Search ..... 5/82 R, 97; 9/5, 6; 114/68, 69

[56] References Cited

U.S. PATENT DOCUMENTS

| | | | |
|---|---|---|---|
| 2,394,264 | 2/1946 | Robinson | 5/82 R |
| 2,410,181 | 10/1946 | Peters | 5/82 R |
| 2,973,889 | 3/1961 | Phillips | 5/82 R |
| 3,798,685 | 3/1974 | Hunt et al. | 5/82 R |
| 3,986,505 | 10/1976 | Power | 5/82 R |
| 4,023,219 | 5/1977 | Shindler | 5/92 |
| 4,033,000 | 7/1977 | Bonifay | 5/82 R |

FOREIGN PATENT DOCUMENTS

| | | |
|---|---|---|
| 442543 | 7/1947 | Canada . |
| 723836 | 12/1965 | Canada . |

*Primary Examiner*—Casmir A. Nunberg
*Attorney, Agent, or Firm*—William G. Gapcynski; Werten F. W. Bellamy; Sherman D. Winters

[57] ABSTRACT

A casualty transport system which provides substantially complete splinting, thermal protection and buoyancy for a patient transported by land, sea or air. The system is particularly suited for ship-to-shore, ship-to-ship or ship-to-helicopter transfers and for mountain rescue. The patient is placed in a glass reinforced plastic body shell having a removable lid which covers all but the head. The body shell is provided with a foam plastic lining premoulded to a 75 percentile man and close splinting, if required, can be achieved by a cast-in-place technique. Lifting handles and lugs and towing eyes are provided on the exterior of the body shell to facilitate lifting and handling.

8 Claims, 4 Drawing Figures

CASUALTY TRANSFER SYSTEM

This invention relates to a casualty transport system and more particularly to a transport system for use in a marine environment.

It is, of course, well known that casualties, both military and civil, frequently require transportation from the site of injury to a hospital, aid station or the like. Such transportation may, without limitation, be within a ship, from ship to shore or vice versa, ship-to-ship or from a mountain or other relatively inaccessible rescue site. Whatever the transportation situation may be, the principal requirement for a stretcher or litter is the comfort, protection and safety of the patient combined with ease of handling. Many casualty transport systems have been developed over the years, including Neil-Robertson and Stokes wicker stretchers, all of which have their attendant disadvantages or shortcomings. For example, neither the Neil-Robertson or Stokes type wicker stretchers provide inherent thermal protection or buoyancy and consequently are not particularly suited to transport of casualties from ship to shore or in relatively cold climates. It is also desirable that the patient should be splinted or otherwise immobilized on the stretcher as much as possible to avoid aggravation of injuries and to simplify handling of the stretcher at different attitudes thereof.

It is an object of the present invention to provide an improved casualty transport system which provides substantially whole body splintage, thermal protection and buoyancy so that the system is particularly suited for marine or mountain use over a wide temperature range.

Thus, by one aspect of this invention there is provided a casualty transport system comprising: (a) a substantially rigid elongated concave body shell member dimensioned to receive a patient in a prone position through an open side thereof; (b) a substantially rigid prefabricated lid member detachably securable over said open side of said body shell to thereby cover said patient from feet to neck; and (c) a resilient lining, covering the concave surface of said body shell, for resiliently supporting said patient in said body shell.

The invention will be described in more detail hereinunder with reference to the drawings, in which.

Figure 4:
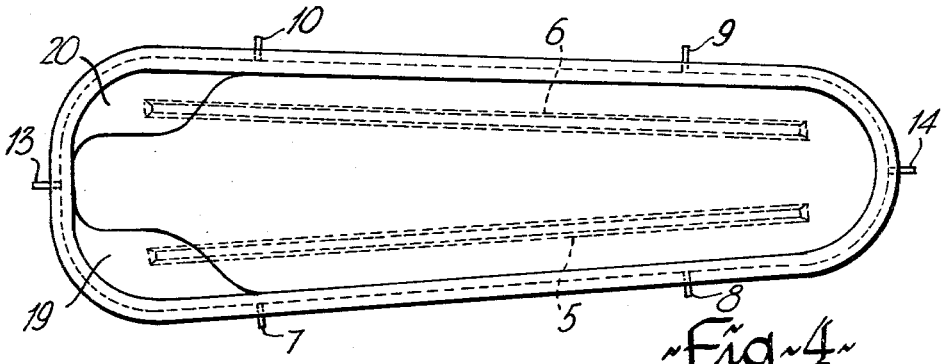
FIG. 4 is a plan view of the apparatus of FIG. 1 with the lid removed.

The apparatus of the present invention comprises (a) a substantially rigid preformed glass reinforced plastic body shell portion 1, (b) a detachable, rigid, preformed glass reinforced plastic lid portion 2 which substantially covers a patient 3 contained in the body portion from feet to neck, and (c) a resilient foamed polyurethane or similar plastic lining 4 in the body shell preferably preformed to a 75 percentile man. The body shell 1 is provided with a pair of longitudinal ribs 5, 6 which act as skids for land use or keels if the shell is floated on water. Lifting lugs 7, 8, 9, 10 are provided so that the entire apparatus can be suspended in a 10°–15° head-up position for ship-to-ship or ship-to-helicopter delivery. Lifting handles (11, 12) are provided adjacent each corner of the shell 1 to facilitate manhandling in close quarters and towing eyes 13, 14 are provided at each end to facilitate towing.

Figure 1:
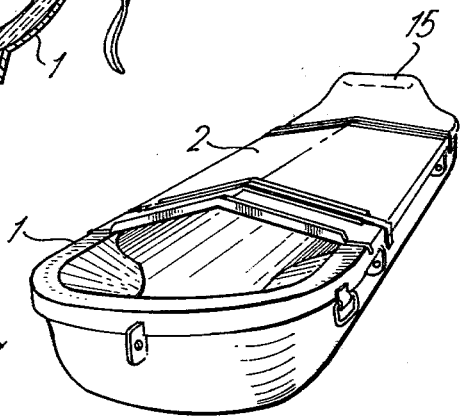
FIG. 1 is an isometric view of one embodiment of the apparatus of the present invention.

Lid 2 incorporates a moulded recess 15 to receive a patient's feet and a moulded lip 16 which overlaps the edge of the body shell 1. A gasket (not shown) may be provided between the shell 1 and lid 2 to ensure water tightness. Lid 2 is secured to the shell 1 by means of straps or other fastening devices 17, 18, as shown in FIG. 1. If desired, lid 2 may be lined with a foam lining to provide additional thermal protection for the patient.

Figure 2:
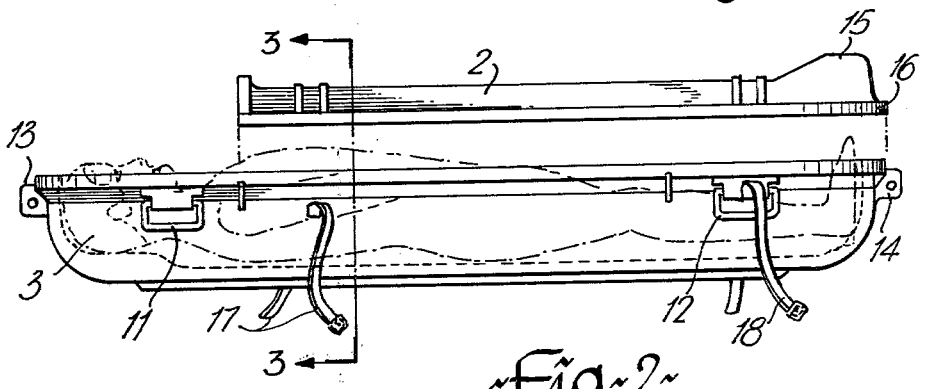
FIG. 2 is a side view of the apparatus of FIG. 1, with the lid raised and showing a patient contained therein.
Figure 3:
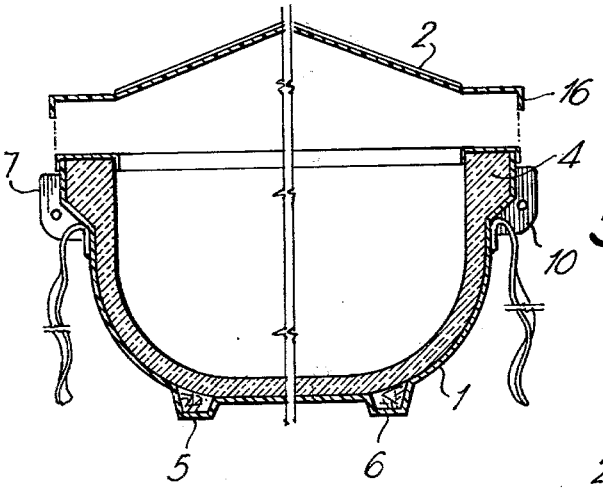
FIG. 3 is a section through the apparatus of FIG. 1 taken along section line 3—3 of FIG. 2.

The foamed plastic lining 4, typically but not essentially Vibrafoam® 402 is premoulded to the dimensions of a "75 percentile man", that is the average dimensions of a man approximately 6 feet tall and weighing up to 220 lbs., as shown most clearly in FIGS. 2 and 4, and is about 1–2" thick, which is sufficient to provide support, thermal protection and buoyancy. Alongside the head recess there may be provided sloping shelves 19, 20 which are designed to receive medical equipment, such as life-sustaining devices, which may be required by the patient during transit. Such equipment may include intravenous transfusion equipment or Abaric Subcutaneous Infusion System Transportable (ASIST) equipment, known, per se, or a warm air breathing apparatus. In the event that the patient requires close splinting, in addition to the support provided by the moulded foam lining 4, this can be provided by a "cast-in-place" technique using polyurethane shelling between the patient and the lining 4, in a manner known per se.

It has also been found that the polyurethane lining will accommodate any tissue oedema while maintaining splintage without risk of circulatory impairment inherent in more conventional more rigid casts.

It will be appreciated by those skilled in the art that many modifications may be effected within the scope of this invention. For example, steel skids or runners may be required for use over rough ground or on snow and ice, and for marine use a face hood may be desirable. Internal ballast or a removable ballast keel may be required for extensive marine use as may additional flotation, in the form of air orally or $CO_2$ cartridge inflated flotation collar or other flotation chambers in order to ensure stability and upright flotation, depending on need in a particular situation. Long rigid handles may be provided at one end of the shell, in addition to or in place of lifting handles 11, 12, to facilitate use of the system by ski patrols and the like for evacuation of casualties from a ski slope.

The embodiments of the invention in which an exclusive property or privilege is claimed are defined as follows:

1. A casualty transport system comprising:

(a) a substantially rigid elongated concave body shell member dimensioned to receive a patient in a prone position through an open side thereof;

(b) a substantially rigid self-supporting prefabricated lid member detachably securable over said open side of said body shell to thereby cover said patient from feet to neck; and (c) a lining of resilient polyurethane foam preformed to the shape of a 75 percentile man, for both resiliently supporting said patient in said body shell and conferring buoyancy and thermal protection to the transport system.

2. A casualty transport system as claimed in claim 1, including lifting handles secured to an outer surface of said body shell.

3. A casualty transport system as claimed in claim 1, including lifting eyes on an outer surface of said body shell to facilitate suspension of said system.

4. A casualty transport system as claimed in claim 1, including towing eyes at each end of said shell to facilitate towing of said system in an aqueous medium.

5. A casualty transport system as claimed in claim 1, wherein said body shell and said lid are prefabricated in a glass reinforced plastic material.

6. A casualty transport system as claimed in claim 1, including skid members on said body shell to facilitate sliding movement of said system.

7. A casualty transport system as claimed in claim 1 including ballast means in said shell member whereby said system floats in an aqueous medium with a head-up attitude.

8. A casualty transport system as claimed in claim 1, wherein said lid member includes a foam lining secured thereto.

* * * * *